US010315890B2

(12) United States Patent
Ylönen

(10) Patent No.: US 10,315,890 B2
(45) Date of Patent: Jun. 11, 2019

(54) ARRANGEMENT FOR DAMPING OSCILLATION OF LOADING MEMBER IN CRANE

(71) Applicant: KONECRANES GLOBAL CORPORATION, Hyvinkää (FI)

(72) Inventor: Urpo Ylönen, Sysmä (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 217 days.

(21) Appl. No.: 15/103,185

(22) PCT Filed: Dec. 11, 2014

(86) PCT No.: PCT/FI2014/050987
§ 371 (c)(1),
(2) Date: Jun. 9, 2016

(87) PCT Pub. No.: WO2015/086910
PCT Pub. Date: Jun. 18, 2015

(65) Prior Publication Data

US 2016/0311663 A1 Oct. 27, 2016

(30) Foreign Application Priority Data

Dec. 12, 2013 (FI) ..... 20136255

(51) Int. Cl.
*B66C 13/06* (2006.01)

(52) U.S. Cl.
CPC ..... *B66C 13/06* (2013.01)

(58) Field of Classification Search
CPC ..... B66C 13/00; B66C 13/04; B66C 13/06; B66B 7/048
See application file for complete search history.

(56) References Cited

U.S. PATENT DOCUMENTS 909,804 A * 1/1909 Kendall ..... B25J 9/101 212/318
1,729,891 A * 10/1929 Moore ..... B66C 13/00 212/291

(Continued)

FOREIGN PATENT DOCUMENTS

CN 203284071 U 11/2013
DE 1 207 578 12/1965

(Continued)

OTHER PUBLICATIONS

DE 3141787 English Abstract (Year: 1983).*

*Primary Examiner* — Michael R Mansen
*Assistant Examiner* — Juan J Campos, Jr.
(74) *Attorney, Agent, or Firm* — Birch, Stewart, Kolasch & Birch, LLP

(57) ABSTRACT

An arrangement for damping oscillation of a loading member in a crane including a trolley, a hoisting mechanism located in the trolley, a hoisting rope suspended from the hoisting mechanism, a loading member fastened to the hoisting rope, the arrangement for damping oscillation of a loading member including a vertical guide projection arranged in an upper part of the loading member, a guide tube fastened to the trolley for receiving the guide projection, damping members arranged in the guide tube and including elastic guide roll structures engaging around the guide projection, each guide roll structure including a roll frame and a guide roll installed therein. Each roll frame is installed on an outer surface of the guide tube, a wall of the guide tube is at each guide roll provided with an opening from which the guide roll penetrates into the guide tube, and elasticity is arranged between the roll frame and the guide tube.

7 Claims, 2 Drawing Sheets

(56) References Cited

U.S. PATENT DOCUMENTS

| | | | | | |
|---|---|---|---|---|---|
| 2,791,453 | A * | 5/1957 | Baker | E04H 12/182 | 248/354.3 |
| 4,496,063 | A * | 1/1985 | Ishii | B66C 17/06 | 212/270 |
| 5,107,963 | A * | 4/1992 | Rocca | B66B 7/048 | 187/410 |
| 5,165,556 | A | 11/1992 | Karhunen | | |
| 5,219,420 | A | 6/1993 | Kiiski et al. | | |
| 5,727,702 | A * | 3/1998 | Kullmann | B66C 1/101 | 212/273 |
| 5,769,250 | A | 6/1998 | Jussila et al. | | |
| 5,915,906 | A * | 6/1999 | Lucking | B66C 13/06 | 212/273 |
| 6,030,168 | A * | 2/2000 | Kroll | B66C 13/06 | 212/273 |
| 6,698,990 | B1 * | 3/2004 | Dobner | B65G 63/004 | 414/139.9 |
| 7,004,338 | B2 * | 2/2006 | Franzen | B65G 1/0464 | 212/319 |
| 7,287,740 | B2 | 10/2007 | Reyes et al. | | |
| 2011/0163058 | A1 | 7/2011 | Franzen et al. | | |
| 2011/0240583 | A1 | 10/2011 | Franzen et al. | | |
| 2011/0240584 | A1 * | 10/2011 | Franzen | B66C 13/08 | 212/324 |

FOREIGN PATENT DOCUMENTS

| | | | | |
|---|---|---|---|---|
| DE | 3141787 | A1 * | 4/1983 | E04H 12/08 |
| DE | 101 05 261 | A1 | 8/2002 | |
| EP | 2 062 845 | A2 | 5/2009 | |
| GB | 1 542 821 | | 3/1979 | |
| JP | 8-268682 | A | 10/1996 | |
| JP | 2000-159476 | A | 6/2000 | |
| JP | 2004-75233 | A | 3/2004 | |
| JP | 2005-179052 | A | 7/2005 | |
| KR | 2001-0057393 | A | 7/2001 | |
| RU | 2013 144 264 | A | 4/2015 | |
| SU | 502830 | | 2/1976 | |
| WO | WO 2012/131154 | A1 | 10/2012 | |

* cited by examiner

ARRANGEMENT FOR DAMPING OSCILLATION OF LOADING MEMBER IN CRANE

BACKGROUND OF THE INVENTION

The invention relates to an arrangement for damping oscillation of a loading member in a crane comprising a trolley, a hoisting mechanism located in the trolley, at least one hoisting rope suspended from the hoisting mechanism, a loading member fastened to the hoisting rope, the arrangement for damping oscillation of a loading member comprising a vertical guide projection arranged in an upper part of the loading member, a guide tube rigidly fastened to the trolley for receiving the guide projection, damping members arranged in the guide tube and comprising elastic guide roll structures arranged to engage around the guide projection, each guide roll structure comprising a roll frame and a guide roll installed therein.

Accelerations and decelerations of a crane are mainly responsible for oscillations of a loading member of the crane. This oscillation may be minimized by driving the crane at a constant speed or sufficiently slowly. Research abounds for damping or eliminating oscillations of a loading member of a crane and a load attached thereto by using various computer programs or speed control methods, e.g. in U.S. Pat. No. 5,219,420. In some cases, particularly in container cranes, oscillation has been suppressed by means of auxiliary ropes and auxiliary drums, cf. for instance U.S. Pat. Nos. 5,769,250 and 7,287,740 as well as DE Patent 1207578.

In many applications also pneumatic or hydraulic dampers are used, cf. for instance GB Patent 1542821. However, when using process cranes in connection with heavy loads, such as vacuum hoists including loading members suspended therefrom, the cranes have to be driven at high speeds required by the course of the process. When the commodity to be moved is then e.g. a paper roll or a corresponding product, it is at high risk of being damaged if the liquids used in the crane leak to the product being moved. Tilting due to the influence of lateral forces may be particularly dangerous when using the aforementioned vacuum hoist, i.e. an underpressure-operated loading member, in which case the load may at worst come off the loading member.

U.S. Pat. No. 5,165,556, in turn, describes a device for damping oscillation of a loading member, comprising downward-pointing brackets attached to the bottom of a trolley. A load is lifted in place between these brackets, and the load is retained rigidly in place while driving the crane, whereby oscillation of the loading member and the load attached thereto is prevented. Such damping systems are expensive, and they require a lot of material and space. The damping of this type has a further disadvantage in that when the loading member is lifted at a high speed between the brackets, a gap formed by the brackets for the loading member has to be wide, which may lead to post-oscillations between the brackets. When the loading member has then been supported rigidly between the brackets, accelerations of the trolley directly influence the load attached to the hoisting member. These lateral forces move the structure, and the forces become large abruptly. This may lead to malfunction or increased risk of collision, particularly when handling large paper rolls, for instance, when the rolls are kept in place by means of a vacuum hoist. The endurance of joints is also at risk, and service is expensive.

From documents JP 08268682 A and KR 20010057393 A, centering of a loading member to a trolley of a crane by means of conical surfaces is known. Therein, a conical loading member centering piece is mounted immovably in the trolley. In the first-mentioned document, the conical surface of the loading member simultaneously serves as a damper.

Document DE 10105261 A1 also discloses centering and interlocking means between a loading member and a trolley as well as vertical damping means provided in the trolley for damping a centering event.

From Finnish Patent Application No. 20115289 is known an arrangement wherein a guide part is arranged in the trolley for receiving a guide projection of the loading member, the damping members connected thereto being arranged in a separate support frame which, in a hoisting direction of the hoisting member, is guidable into its place in a dock arranged underneath the trolley and which is lowerable off the dock, onto the loading member. The guide part is formed as a floating guide tube structure, and the damping members comprise a plurality of side damping modules connected between a side wall of the guide tube structure and the support frame, around the guide tube structure for damping horizontal movement of the guide tube structure. Further, a support joint is arranged in an upper part of the support frame, from which the guide tube structure is suspended. This structure is complex and thus quite challenging to implement in its entirety.

In SU 502830 A1, a load is lifted into a tube downwardly extending from a trolley, wherein the load is supported laterally in the tube by means of suspended wheels provided at ends of lever arms.

SUMMARY OF THE INVENTION

An object of the invention is to eliminate the drawbacks of the above-described prior art and to provide an advantageous and simple solution to the problem. This object is achieved by an arrangement according to the invention, which is characterized in that each roll frame is installed on an outer surface of the guide tube, a wall of the guide tube is at each guide roll provided with an opening from which the guide roll penetrates into the guide tube, and elasticity is arranged between the roll frame and the guide tube.

Preferred embodiments of the invention are disclosed in the dependent claims.

As compared with the previous solutions, the solution according to the invention takes very little space and the lifting height of the crane may be utilized in a better way, since the guide tube may be installed higher than conventionally. The arrangement may be applied in connection with various loading members since its guide projection is installed in the centre of the loading member. The fastening of the guide roll structure is simple and the number of parts necessary for the guide roll structure may be minimized. All components associated with the arrangement are serviceable from the trolley without a separate service platform. The loading member may be lifted at a high speed up into the guide tube. The elasticity of the damping members reduces stresses on the trolley and makes loads safer to hoist and transport.

LIST OF FIGURES

The invention is now described in closer detail in connection with one preferred embodiment thereof and with reference to the accompanying drawings, in which.

DETAILED DESCRIPTION OF THE INVENTION

Figure 1:
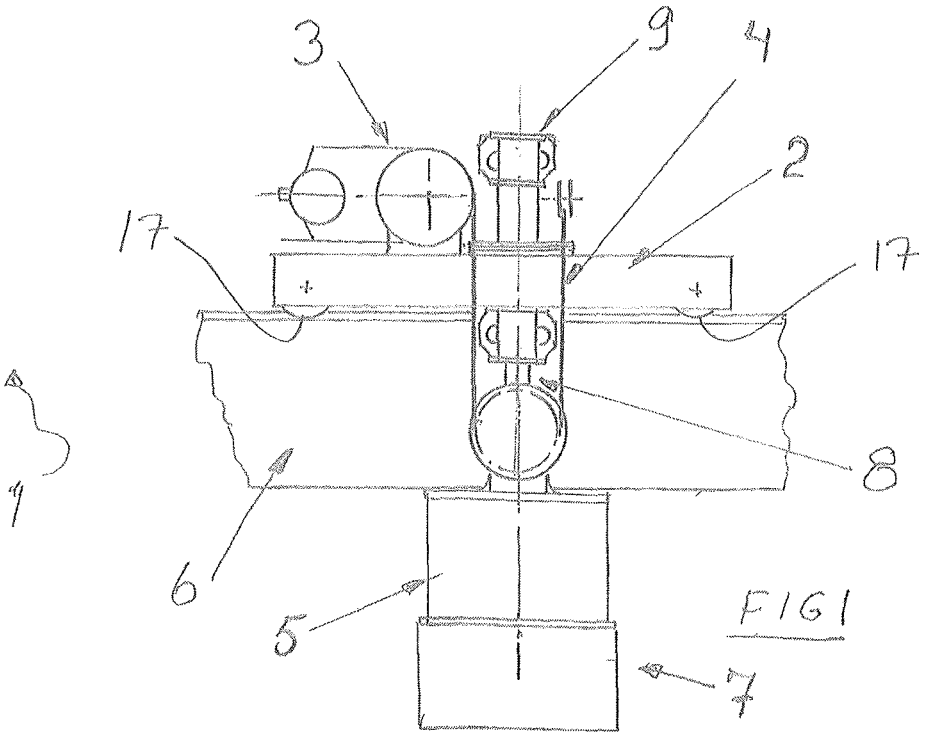
FIG. 1 is a side view showing a crane and an arrangement according to the invention.

First referring to FIG. 1 in particular, a crane 1 is shown therein which is provided with an arrangement according to the invention for damping oscillation of a loading member 5. The crane 1 comprises a trolley 2, a hoisting mechanism 3 located in the trolley 2, a hoisting rope 4 suspended from the hoisting mechanism 3, and the loading member 5 fastened to the hoisting rope 4. Resting on its wheels 17, the trolley 2 moves along a main support 6 of the crane 1. The loading member 5 shown herein is typically a vacuum hoist or a mechanical gripper.

Figure 2:
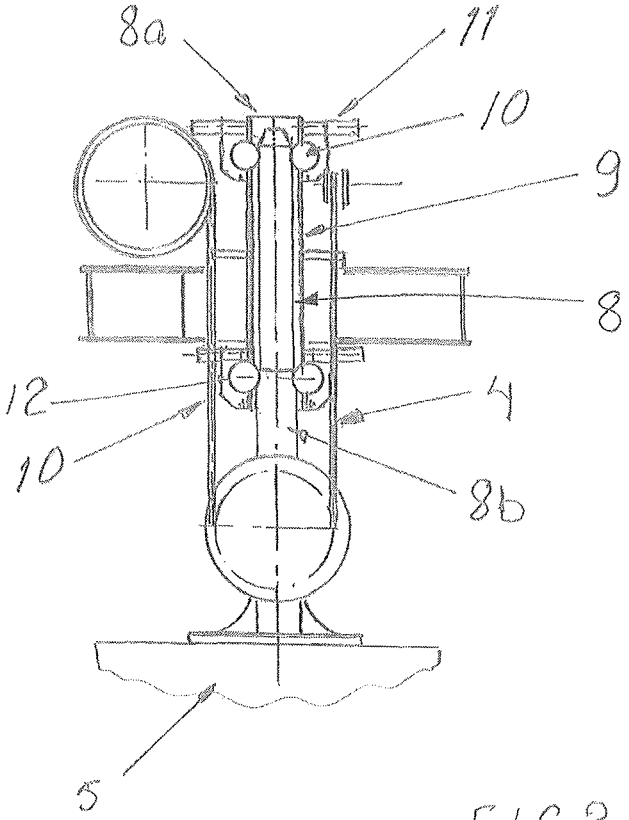
FIG. 2 is a more detailed presentation showing an entity formed by a guide projection, a guide tube and guide roll structures according to the invention.

Referring further to FIG. 2, the arrangement for damping oscillation of the loading member 5 and, of course, at the same time the oscillation of a load 7 fastened thereto, comprises a vertical guide projection 8 arranged in an upper part of the loading member 5 and comprising an upper end 8*a* and a lower end 8*b* (and enabling the hoisting rope 4 to pass therethrough if only one rope is provided), a vertical guide tube 9 rigidly fastened to the trolley 2 for receiving the guide projection 8, damping members arranged in the guide tube 9 and comprising elastic guide roll structures 10 arranged to engage around the guide projection 8 (when the guide projection 8 penetrates into the guide tube 9), each guide roll structure 10 comprising a roll frame 11 and a guide roll 12 installed therein.

Each roll frame 11 is installed on an outer surface of the guide tube 9, and a wall of the guide tube 9 is at each guide roll 12 provided with an opening 13 from which the guide roll 12 protrudes or penetrates into the guide tube 9 by a selected distance from an inner surface of the guide tube 9, elasticity being arranged between the roll frame 11 and the guide tube 9.

The guide roll structures 10 are arranged in a lower and an upper part of the guide tube 9 and, in this example, at least four of them are provided in the same vertical plane and arranged uniformly spaced along a circumference of the guide tube 9. The guide roll structures 10 may also be provided in a plurality of vertical planes or optionally in one plane only. Their mutual vertical position may also vary slightly "in the same elasticity circle" (within an area determined by two vertical planes).

Most appropriately, the control tube 9 is circular cylindrical and the guide projection 8 is a bar or a post with a circular cross-section.

The higher the guide tube 9 is positioned in the trolley 2, the more lifting height is provided for the load 7. In this example, the guide tube 9 extends substantially to a level of an upper surface of the trolley 2.

Figure 3:
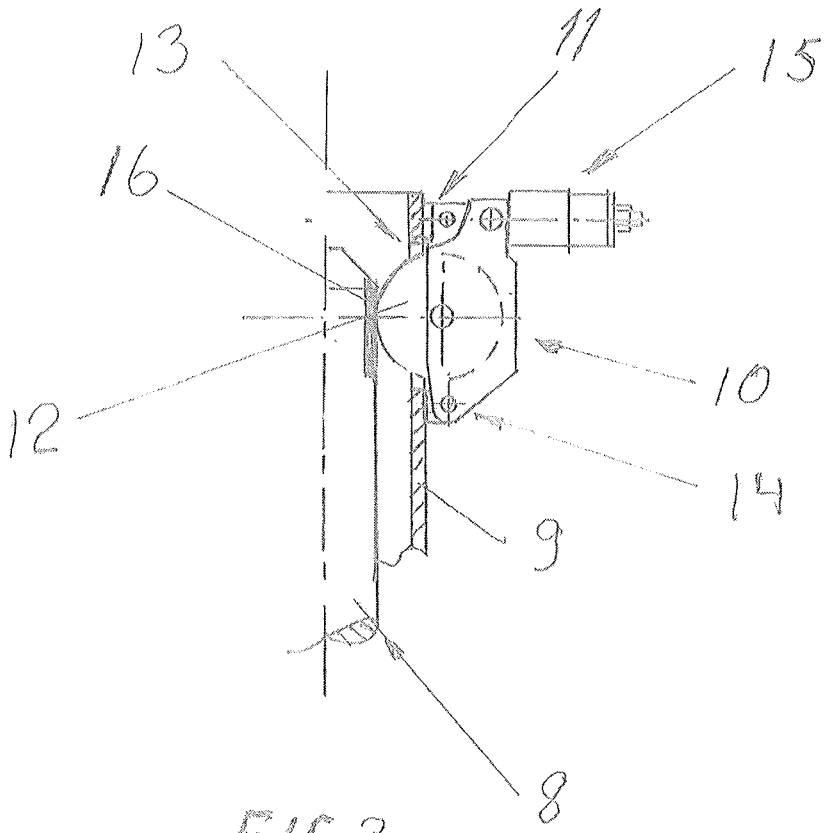
FIG. 3 shows a principle of a guide roll structure and a damper unit according to the invention.

Referring further to FIG. 3, a lower part of the roll frame 11 is fastened to pivot on the outer surface of the guide tube 9 around a lower joint 14 in the vertical plane, and between an upper part of the roll frame 11 and the outer surface of the guide tube 9 is arranged a spring 15 to enable the guide roll 12 to be outwardly elastic. The spring 15 may be a coil spring, either as a pressure or draw spring. It is also feasible to use other springs, such as a cup spring. Elasticity and damping may also be implemented by means of hydraulic cylinders and/or dampers. Spring constants are selected according to the desired elasticity, and they may be different in the upper and lower part of the guide tube 9. The elasticity and/or dampening property may be implemented so that its magnitude is adjustable to different levels for different lifting and lowering situations. When driving a crane in different directions of travel, the elasticity and/or damping property is also selectably adjustable. Typically, for instance, upon detaching a load a low stiffness effect may be used while a higher stiffness effect may be used during lateral movements of a hoisting device. Adjustability is implementable e.g. pneumatically or hydraulically. Electric adjustment is also possible by means of electromagnets, for instance. The placement of pivoting and elasticity of the roll frame 11 may also be reversed, such that pivoting comes up and elasticity down. The roll frame 11 may also be fastened to the guide tube 9 by means of said elasticity means only.

The guide projection 8 is provided with slide blocks 16 which are preferably made of plastic and which come into cooperation with the guide rolls 12 preferably made of steel.

The guide projection 8 comprises a lower part 8*b* and an upper part 8*a*, in which case the diameter of the upper part 8*a* may be smaller than the diameter of the lower part 8*b*. In such a case, the guide rolls 12 placed higher in the guide tube 9 are allowed to penetrate a longer distance inside the guide tube 9. This may be implemented by adjusting the distance of the joint 14 and the spring 15 from the surface of the guide tube 9.

The guide projection 8 is dimensioned to be shorter than the guide tube 9 such that when the guide projection 8 is in its highest position in the guide tube 9, enough empty space is provided between an end of the guide projection 8 and an end of the guide tube 9.

When driving the trolley 2, lateral forces may basically be generated by three cases:

normal driving situation, the maximum acceleration being in the order of 0.3 $m/s^2$ emergency braking in the midst of driving movement, the maximum acceleration being in the order of 0.6 $m/s^2$ the trolley is driven at a high speed against stop bumpers, the maximum acceleration being at its maximum in the order of 0.6 $m/s^2$.

The guide rolls 12 and the slide blocks 16 are dimensioned to receive lateral forces typically caused by accelerations of the first two aforementioned orders. Lateral forces caused by the third, i.e. the highest, order are received such that the guide rolls 12 are sidewardly elastic and the guide projection 8 is in direct contact with the surrounding guide tube 9.

The above description of the invention is only intended to illustrate the basic idea of the invention. A person skilled in the art may thus vary its details within the scope of the attached claims.

The invention claimed is:

1. An arrangement for damping oscillation of a loading member in a crane comprising a trolley, a hoisting mechanism located in the trolley, at least one hoisting rope suspended from the hoisting mechanism, a loading member fastened to the hoisting rope, the arrangement for damping oscillation of a loading member comprising a vertical guide projection arranged in an upper part of the loading member, a guide tube fastened to the trolley for receiving the guide projection, damping members arranged in the guide tube and comprising guide roll structures arranged to engage around the guide projection, each guide roll structure comprising a roll frame and a guide roll installed therein, wherein each roll frame is installed on an outer surface of the guide tube, a wall of the guide tube is provided with an opening for each guide roll to penetrate into the guide tube, and the guide roll is elastically movable in a radial direction of the vertical guide projection, and wherein the guide projection is provided with slide blocks engaging with the guide rolls.

2. The arrangement as claimed in claim 1, wherein the guide roll structures are arranged in a lower part and an upper part of the guide tube.

3. The arrangement as claimed in claim 1, wherein the guide roll structures include at least four guide roll structures provided in the same vertical plane and arranged uniformly spaced along a circumference of the guide tube.

4. The arrangement as claimed in claim 1, wherein spring is arranged between the roll frame and the guide tube.

5. The arrangement as claimed in claim 1, wherein the guide tube is circular cylindrical and the guide projection is a bar or a post with a circular cross-section.

6. The arrangement as claimed in claim 1, wherein the guide tube extends substantially to a level of an upper surface of the trolley.

7. The arrangement as claimed in claim 1, wherein a lower part of the roll frame is fastened to pivot on the outer surface of the guide tube in a plane perpendicular to a rotating axis of the guide roll, and an upper part of the roll frame engages with a spring to be movable in the radial direction with respect to the guide tube.

* * * * *